US007764059B2

(12) United States Patent
Migliavacca

(10) Patent No.: US 7,764,059 B2
(45) Date of Patent: Jul. 27, 2010

(54) VOLTAGE REFERENCE CIRCUIT AND METHOD THEREFOR

(75) Inventor: Paolo Migliavacca, Mauzac (FR)

(73) Assignee: Semiconductor Components Industries L.L.C., Phoenix, AZ (US)

( * ) Notice: Subject to any disclaimer, the term of this patent is extended or adjusted under 35 U.S.C. 154(b) by 508 days.

(21) Appl. No.: 11/613,589

(22) Filed: Dec. 20, 2006

(65) Prior Publication Data

US 2008/0150502 A1 Jun. 26, 2008

(51) Int. Cl.
*G05F 1/16* (2006.01)

(52) U.S. Cl. ..... 323/316; 323/280; 327/538

(58) Field of Classification Search ..... 323/312–316, 323/280; 327/538–541
See application file for complete search history.

(56) References Cited

U.S. PATENT DOCUMENTS

| | | | | |
|---|---|---|---|---|
| 5,767,664 | A * | 6/1998 | Price | 323/313 |
| 6,400,213 | B2 * | 6/2002 | Shih et al. | 327/540 |
| 6,771,055 | B1 * | 8/2004 | Bell | 323/315 |
| 6,946,825 | B2 * | 9/2005 | Tesi | 323/313 |
| 6,972,549 | B2 | 12/2005 | Brass et al. | |

* cited by examiner

*Primary Examiner*—Jessica Han
(74) *Attorney, Agent, or Firm*—Robert F. Hightower

(57) ABSTRACT

In one embodiment, a voltage reference circuit is configured to use two differentially coupled transistors to form a delta Vbe for the voltage reference circuit.

19 Claims, 2 Drawing Sheets

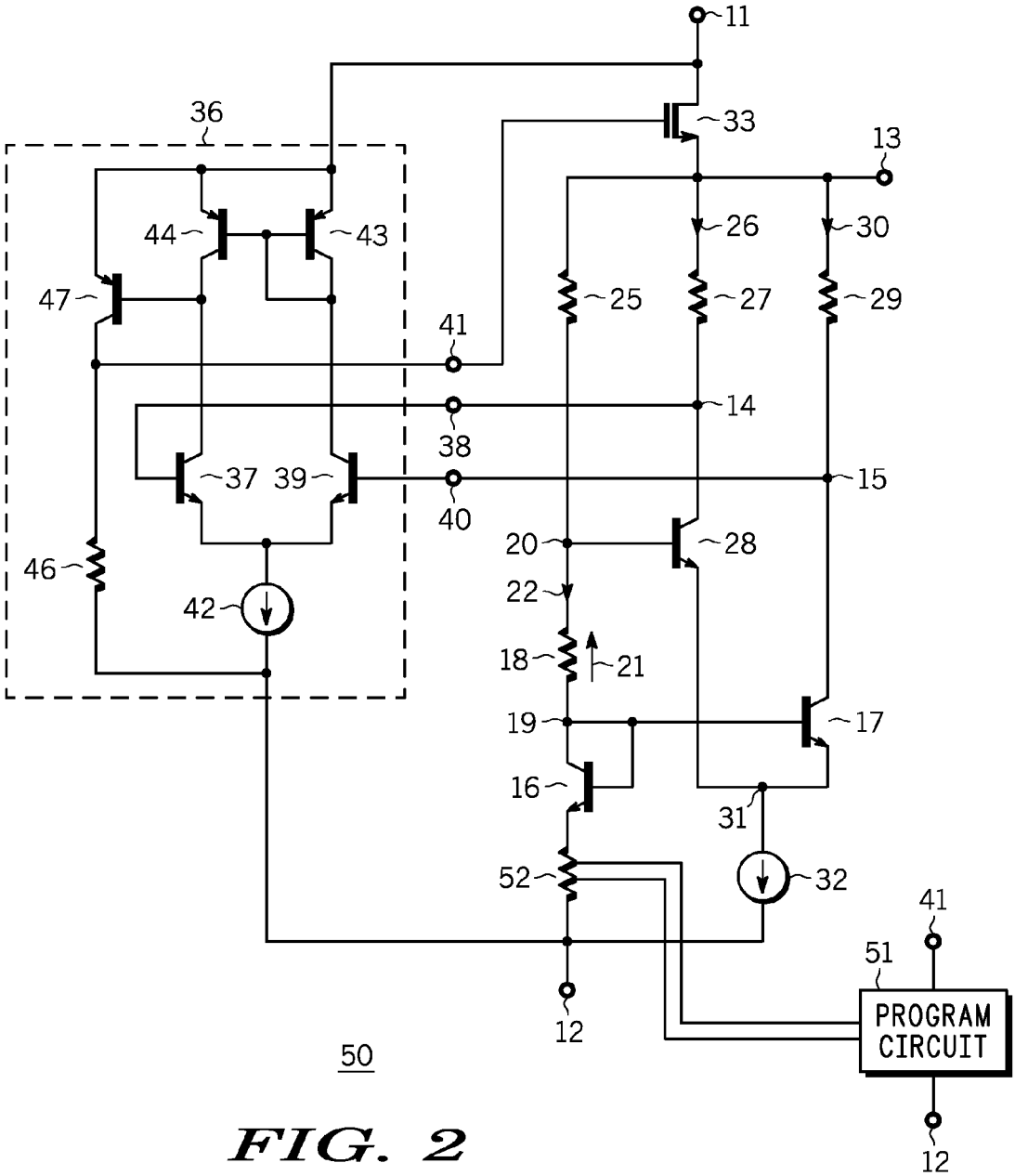
FIG. 2
FIG. 3
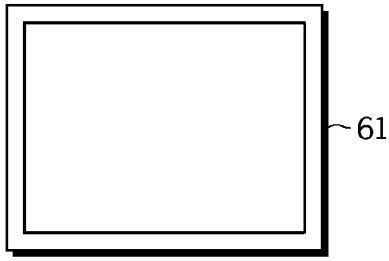

VOLTAGE REFERENCE CIRCUIT AND METHOD THEREFOR

BACKGROUND OF THE INVENTION

The present invention relates, in general, to electronics, and more particularly, to methods of forming semiconductor devices and structure.

In the past, the electronics industry utilized various methods and structures to build voltage reference circuits. The voltage reference circuits generally were used to supply a stable reference voltage for use by other circuits such as a comparator circuit. One commonly used design technique to form the voltage reference circuits used a bandgap reference as a portion of the voltage reference circuit. One design parameter for the prior voltage reference circuits was to reduce variations in the reference voltage that resulted from variations in the value of the input voltage that was used to operate the voltage reference circuit. This is sometimes referred to as power supply rejection. One example of a prior voltage reference circuit was disclosed in U.S. Pat. No. 6,972,549 that issued to Brass et al. on Dec. 6, 2005. However, such prior voltage reference circuits did not provide sufficient power supply rejection.

Accordingly, it is desirable to have a voltage reference circuit that has improved power supply rejection.

BRIEF DESCRIPTION OF THE DRAWINGS

FIG. 2 schematically illustrates an embodiment of a portion of another voltage reference circuit that is an alternate embodiment of the voltage reference circuit of FIG. 1 in accordance with the present invention; and FIG. 3 schematically illustrates an enlarged plan view of a semiconductor device that includes the voltage reference circuit of FIG. 1 in accordance with the present invention.

Figure 1:
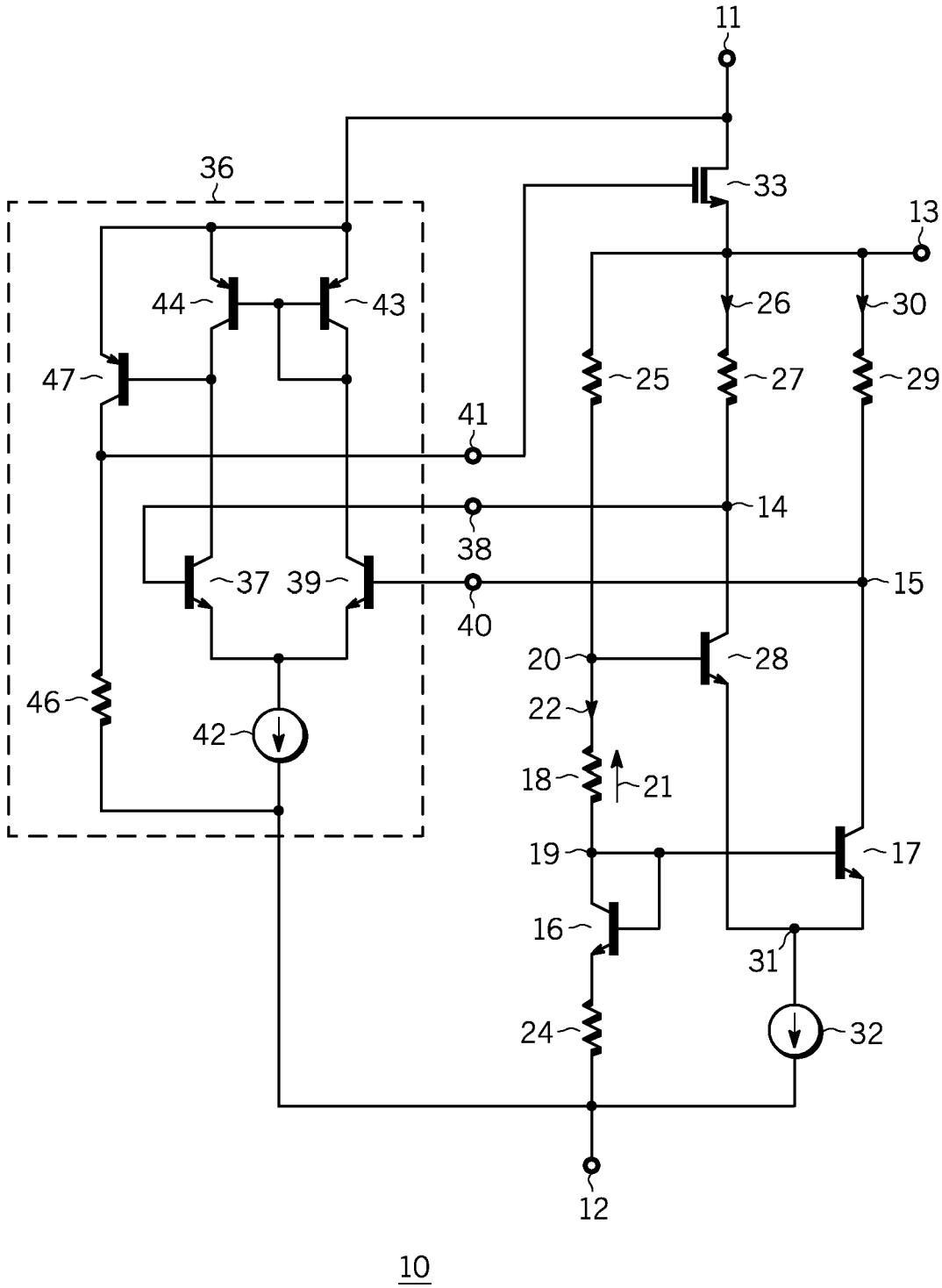
FIG. 1 schematically illustrates an embodiment of a portion of a voltage reference circuit in accordance with the present invention.

For simplicity and clarity of the illustration, elements in the figures are not necessarily to scale, and the same reference numbers in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current through the device such as a gate of an MOS transistor or a base of a bipolar transistor. Although the devices are explained herein as certain N-channel or P-Channel devices, a person of ordinary skill in the art will appreciate that complementary devices are also possible in accordance with the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action.

DETAILED DESCRIPTION OF THE DRAWINGS

FIG. 1 schematically illustrates a portion of an embodiment of a voltage reference circuit 10 that has improved power supply rejection. Voltage reference circuit 10 receives an input voltage to operate circuit 10 between an input terminal 11 and a common return terminal 12 and forms a stable reference voltage on an output 13 of circuit 10. As will be seen further hereinafter, circuit 10 utilizes two transistors coupled as a differential pair that form a delta Vbe of a bandgap reference portion of circuit 10. Circuit 10 includes NPN bipolar transistors 17 and 28 that are connected in a differential pair. A current source 32 and load resistors 27 and 29 usually are connected to transistors 17 and 28. A control loop of circuit 10 includes an operational amplifier 36 and a control transistor 33. Circuit 10 also includes series connected resistors 18, 24, and 25 in addition to a diode coupled transistor 16 that is connected in series with resistors 18, 24, and 25. Operational amplifier 36 includes differentially coupled transistors 37 and 39 in addition to a current source 42, load transistors 43 and 44, and a second stage with a transistor 47 and a resistor 46 that assist in forming the operational amplifier. An input 40 of amplifier 36 provides an input signal to transistor 39 and an input 38 provides an input signal to transistor 37. An output 41 of amplifier 36 is connected to control transistor 33.

Amplifier 36 receives the value of the collector voltage of transistors 17 and 28 that are formed at respective nodes 14 and 15. The control loop of amplifier 36 and transistor 33 are configured to regulate the value of the voltage at nodes 14 and 15 to be substantially equal. In the preferred embodiment, resistors 27 and 29 have equal values so that the value of respective currents 26 and 30 through resistors 27 and 29 are substantially equal. Those skilled in the art will appreciate that the value of resistors 27 and 29 are also chosen to provide the desired open loop gain for amplifier 36 and transistor 33. Thus, the value of currents 26 and 30 through respective transistors 28 and 17 are also equal.

Transistors 17 and 28 are formed to have active areas that have different sizes so that the Vbe of transistors 17 and 28 are not the same value. In the preferred embodiment, transistor 17 has an active area that is about eight (8) times larger than the active area of transistor 28 so that in operation the value of the Vbe of transistor 17 is approximately ten percent (10%) less than the value of the Vbe of transistor 28. Also, since transistors 17 and 28 have substantially equal current values but different active area sizes the Vbe of transistor 17 has to be less than the Vbe of transistor 28. Current source 32 causes the sum of currents 26 and 30 to be substantially constant. Resistor 18 is connected between the base of transistor 28 and the base of transistor 17 to receive a voltage that is approximately the difference between the Vbe of transistor 28 and the Vbe of transistor 17. This voltage difference is often referred to as the delta Vbe of the bandgap reference circuit formed by transistors 17 and 28. Thus, a voltage 21 that is developed across resistor 18 is equal to the delta Vbe. The delta Vbe received by resistor 18 causes a current 22 to flow through resistor 18. Thus, the value of current 22 is representative of the delta Vbe. The current mirror configuration between transistors 16 and 17 set the polarity and the value of the voltage at a node 31.

Current 22 flows through resistors 25, 18, transistor 16, and resistor 24. Consequently, the value of the reference voltage formed on output 13 is substantially equal to:

$$Vref=16Vbe+\text{delta}Vbe+((\text{delta}Vbe/R18)(R24+R25))=16Vbe+((\text{delta}Vbe/R18)(R24+R25+R18)).$$

where;

Vref—the output voltage on output 13,

16Vbe—the Vbe of transistor 16, deltaVbe—the delta Vbe,

R18—the value of resistor 18,

R24—the value of resistor 24, and

R25—the value of resistor 25.

Configuring amplifier 36 to receive the collector voltage of transistors 17 and 28 that form the delta Vbe minimizes the variations of delta Vbe that result from variations of the input signals to amplifier 36 as the value of the input voltage on input terminal 11 varies. This minimizes variations in the output voltage as the input voltage varies. If the input voltage changes, any changes in the value of the input signals received by amplifier 36 has little effect on the delta Vbe value. It is believed that circuit 10 improves power supply rejection by approximately 7 db. Additionally, connecting the inputs of amplifier 36 to the collectors of transistors 17 and 28 improves the accuracy of the reference voltage formed on output 13. For example, if amplifier 36 has some input offset, the offset is reflected on the collectors of transistors 17 and 28 but has very little effect on the value of the delta Vbe formed across resistor 21. It is believed that this improves the accuracy of the value of the reference voltage by two to three (2-3) times over the prior art.

The value of the current supplied by transistor 33 to a load (not shown) on output 13 depends on the size of transistor 33 and the value of the input voltage on input terminal 11. The load connected to output 13 may be a passive load or an active load such as a transistor that is a portion of another electrical circuit. If transistor 33 is large, transistor 33 can provide a large current at low values of the input voltage. In one example embodiment, transistor 33 could supply up to seven hundred milli-amperes (700 ma.) at input voltage values as low as about 2.0 volts.

In order to facilitate this functionality for circuit 10, a collector of transistor 17 is commonly connected to node 15 and a first terminal of resistor 29 which has a second terminal connected to output 13. An emitter of transistor 17 is commonly connected to a first terminal of current source 32 and an emitter of transistor 28. A collector of transistor 28 is commonly connected to node 14 and a first terminal of resistor 27 which has a second terminal connected to output 13. A base of transistor 17 is commonly connected to a base and a collector of transistor 16. An emitter of transistor 16 is connected to a first terminal of resistor 24 which has a second terminal connected to return terminal 12. A second terminal of current source 32 is connected to return terminal 12. The collector of transistor 16 is connected to node 19 and to a first terminal of resistor 18. A second terminal of resistor 18 is commonly connected to a node 20, the base of transistor 28, and a first terminal of resistor 25. Resistor 25 has a second terminal connected to output 13. Input 38 of amplifier 36 is connected to node 14 and input 40 of amplifier 36 is connected to node 15. Output 41 of amplifier 36 is connected to a gate of transistor 33. A base of transistor 39 is connected to input 40, an emitter is connected to a first terminal of current source 42. A second terminal of source 42 is connected to return terminal 12. A collector and a base of a transistor 43 are connected to a collector of transistor 39, and an emitter is connected to input terminal 11. A base of transistor 37 is connected to input 38, and an emitter is connected to the first terminal of current source 42. A base of a transistor 44 is connected to the base of transistor 43, a collector is connected to the collector of transistor 37, and an emitter is connected to input terminal 11. A base of a transistor 47 is connected to the collector of transistor 44, an emitter is connected to input terminal 11, and a collector is connected to output 41 and a first terminal of a resistor 46. A second terminal of resistor 46 is connected to return terminal 12. A source of transistor 33 is connected to output 13 and a drain is connected to input terminal 11.

FIG. 2 schematically illustrates a portion of an embodiment of a voltage reference circuit 50 that is an alternate embodiment of circuit 10 that was explained in the description of FIG. 1. Circuit 50 is similar to circuit 10 except that resistor 24 is replaced with a resistor 52. Resistor 52 is similar to resistor 24 except that resistor 52 is formed as a series of resistor segments. The total value of all the resistor segments generally provides the same resistance as resistor 24. However, the value of resistor 52 can be modified by a programming circuit 51. Circuit 51 generally receives a programming word that is used to set the value of a storage element within circuit 51. The value stored in the storage element is used to short across some of the resistor segments of resistor 52 thereby configuring the actual resistance of resistor 52. The storage element may be a resistive fuse or a memory element such as an EPROM or any other well-known storage element. Circuits and methods to implement circuit 51 are well known to those skilled in the art. Programming circuit 51 normally has an NMOS transistor to perform the short circuit of a portion of resistor 52. The gate of this NMOS transistor usually is driven by an inverter which reads the state of the storage element. When the gate of the NMOS transistor is pulled up by the inverter, the gate of the NMOS transistor is considered connected to the supply of circuit 51. If the power supply voltage of circuit 51 is connected to terminal 11, every variation of the voltage on terminal 11 is coupled through the NMOS transistor to the portion of resistor 52 and so to the reference voltage on output 13. The voltage on the output 41 of amplifier 36 varies less than the input voltage on terminal 11. If the power supply voltage of circuit 51 is connected to output 41, the coupling to the reference voltage is minimized. If the PSSR on output 13 is good, the output of amplifier 36 has the same PSRR because 33 is a voltage follower.

In the embodiment illustrated in FIG. 2, circuit 51 receives power from output 41 of amplifier 36. Alternately, circuit 51 may receive power from output 13. Using output 41 provides circuit 51 a higher operating voltage value than using output 13.

FIG. 3 schematically illustrates an enlarged plan view of a portion of an embodiment of a semiconductor device or integrated circuit 60 that is formed on a semiconductor die 61. Circuit 10 is formed on die 61. Die 61 may also include other circuits that are not shown in FIG. 3 for simplicity of the drawing. Circuit 10 and device or integrated circuit 60 are formed on die 61 by semiconductor manufacturing techniques that are well known to those skilled in the art.

In view of all of the above, it is evident that a novel device and method is disclosed. Included, among other features, is using a pair of differentially coupled transistors to form a delta Vbe generation circuit. Using the differentially coupled transistors improves the power supply rejection of the voltage reference circuit.

While the subject matter of the invention is described with specific preferred embodiments, it is evident that many alternatives and variations will be apparent to those skilled in the semiconductor arts. For example, current sources 32 and 42 may be each be replaced by a resistor. Additionally, resistors 27 and 29 may be replaced by current sources. Additionally, transistors 37 and 39 may be MOS transistors and amplifier 36 may be an MOS or CMOS amplifier instead of a bipolar amplifier. Additionally, the word "connected" is used throughout for clarity of the description, however, it is intended to have the same meaning as the word "coupled". Accordingly, "connected" should be interpreted as including either a direct connection or an indirect connection.

The invention claimed is:

1. A voltage reference circuit comprising:

a first transistor having a first active area, a first current carrying electrode, a second current carrying electrode, and a control electrode wherein the first active area is configured to form a first Vbe and wherein the first transistor is not coupled in a diode configuration;

a second transistor having a first current carrying electrode, a second current carrying electrode, a control electrode, and a second active area that is smaller than the first active area wherein the second active area is configured to form a second Vbe that is greater than the first Vbe and wherein the second transistor is not coupled in a diode configuration;

a first resistor coupled to receive a difference between the first Vbe and the second Vbe, the first resistor having first and second terminals; and an operational amplifier having a first input coupled to the first current carrying electrode of the first transistor and a second input coupled to the first current carrying electrode of the second transistor.

2. The voltage reference circuit of claim 1 wherein the first transistor is a first bipolar transistor with the first input of the operational amplifier coupled to a collector of the first bipolar transistor, and wherein the second transistor is a second bipolar transistor with the second input of the operational amplifier coupled to a collector of the second bipolar transistor.

3. The voltage reference circuit of claim 1 further including a third transistor coupled in a diode configuration and having a control electrode commonly coupled to a first current carrying electrode of the third transistor, the control electrode of the first transistor, and the first terminal of the first resistor, the third transistor having a second current carrying electrode.

4. The voltage reference circuit of claim 3 further including a second resistor coupled in series with the first resistor, and a third resistor coupled in series with the first resistor.

5. The voltage reference circuit of claim 4 wherein the first, second, and third transistors are bipolar transistors.

6. The voltage reference circuit of claim 1 further including a current source coupled to the second current carrying electrode of the first transistor and to the second current carrying electrode of the second transistor.

7. The voltage reference circuit of claim 1 further including a second resistor coupled between the first current carrying electrode of the first transistor and an output of the voltage reference circuit and including a third resistor coupled between the first current carrying electrode of the second transistor and the output of the voltage reference circuit.

8. The voltage reference circuit of claim 1 further including a control transistor coupled to receive an output of the operational amplifier and control a current to flow through the first and second transistors.

9. The voltage reference circuit of claim 1 wherein the first resistor is coupled between the control electrode of the first transistor and the control electrode of the second transistor.

10. A method of forming a voltage reference circuit comprising:

coupling a first transistor and a second transistor in a differential pair configuration;

configuring the first transistor to have a first Vbe that is less than a second Vbe of the second transistor;

coupling a control electrode of the first transistor to a first terminal of a first resistor and coupling a control electrode of the second transistor to a second terminal of the first resistor wherein a difference between the first Vbe and the second Vbe forms a voltage across the first resistor and wherein neither the first nor second transistors are coupled in a diode configuration; and coupling a control electrode of a third transistor to a control electrode of the first transistor.

11. The method of claim 10 further including coupling the first resistor to receive the first Vbe and the second Vbe and form a first current that is representative of a difference between the first Vbe and the second Vbe.

12. The method of claim 11 further including coupling a second resistor in series with the first resistor to receive the first current.

13. The method of claim 12 further including coupling a third resistor in series with the first resistor to receive the first current and coupling the third transistor in a diode configuration and in series with the first resistor.

14. The method of claim 10 wherein coupling the first transistor and the second transistor in the differential pair configuration includes coupling a current source to form a bias current through the first and second transistors.

15. The method of claim 10 wherein coupling the first transistor and the second transistor in the differential pair configuration includes coupling a first resistor between the first transistor and an output of the voltage reference circuit and coupling a second resistor between the second transistor and the output of the voltage reference circuit.

16. A method of forming a voltage reference circuit comprising:

coupling a first transistor and a second transistor in a differential pair configuration;

configuring the first transistor to have a first active area that is larger than a second active area of the second transistor wherein neither the first nor second transistors are coupled in a diode configuration;

coupling a control electrode of the first transistor to a first terminal of a first resistor;

coupling a control electrode of the second transistor to a second terminal of the first resistor and coupling a first current carrying electrode of the second transistor to a first current carrying electrode of the first transistor;

coupling a first input of a differential amplifier to a second current carrying electrode of the first transistor, coupling a second input of the differential amplifier to a second current carrying electrode of the second transistor; and coupling an output of the differential amplifier to a current source to control current flow through the first and second transistors.

17. The method of claim 16 wherein configuring the first transistor to have the first active area that is larger than the second active area includes configuring the first transistor to form a first Vbe that is less than a second Vbe of the second transistor wherein a difference between the first Vbe and the second Vbe forms a voltage across the first resistor, and coupling a current source to form a bias current through the first and second transistors.

18. The method of claim 17 further including coupling the first resistor to receive the difference between the first Vbe and the second Vbe and form a first current that is representative of the difference between the first Vbe and the second Vbe.

19. The method of claim 16 wherein coupling the output of the differential amplifier to the current source includes coupling first and second transistors of the differential amplifier in a differential pair configuration, and coupling a control electrode of a third transistor of the differential amplifier to a current carrying electrode of the second transistor of the differential amplifier and coupling a first current carrying electrode of the third transistor of the differential amplifier to the output of the differential amplifier.

* * * * *